US006456805B2

(12) United States Patent
Buttles et al.

(10) Patent No.: US 6,456,805 B2
(45) Date of Patent: Sep. 24, 2002

(54) SYSTEMS AND METHODS FOR REDUCING LIGHT SHOCK TO A PHOTORECEPTIVE MEMBER

(75) Inventors: Patrick J. Buttles, Ontario, NY (US); Moritz P. Wagner, Walworth, NY (US); John D. Desmore, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/799,614

(22) Filed: Mar. 7, 2001

Related U.S. Application Data

(63) Continuation of application No. 09/449,345, filed on Nov. 24, 1999.

(51) Int. Cl.[7] ..... G03G 15/04; G03G 21/00
(52) U.S. Cl. ..... 399/128; 399/51
(58) Field of Search ..... 399/46, 51, 128, 399/129; 430/902

(56) References Cited

U.S. PATENT DOCUMENTS

| | | | | |
|---|---|---|---|---|
| 4,110,026 A | | 8/1978 | Farley et al. | |
| 4,119,373 A | | 10/1978 | Frishman et al. | |
| 4,477,179 A | | 10/1984 | Inuzuka et al. | |
| 5,631,727 A | * | 5/1997 | Ehara et al. | 399/128 |
| 5,701,560 A | | 12/1997 | Tsujita et al. | |
| 6,070,032 A | | 5/2000 | Rokutanda et al. | |

* cited by examiner

*Primary Examiner*—Hoang Ngo
(74) *Attorney, Agent, or Firm*—Oliff & Berridge, PLC

(57) ABSTRACT

A light source within a photocopy machine continuously shines high level, wide band fluorescent light on the photoreceptor to maintain the photoreceptor in a uniformly light-shocked condition. This constant level of light shock has no adverse effects on either the life or performance of the photoreceptor in normal operation. Thus, the photoreceptor becomes less sensitive to unintentional, uneven ambient room light and random, long lasting delta voltages within the print area are reduced so that print quality defects are minimized.

11 Claims, 6 Drawing Sheets

SYSTEMS AND METHODS FOR REDUCING LIGHT SHOCK TO A PHOTORECEPTIVE MEMBER

This is a continuation of application Ser. No. 09/449,345 filed Nov. 24, 1999. The entire disclosure of the prior application(s) is hereby incorporated by reference herein in its entirety.

BACKGROUND OF THE INVENTION

1. Field of the Invention

This invention relates to image forming systems that incorporate light sensitive photoreceptors.

2. Description of Related Art

Generally, electrophotographically forming an image includes charging a photoconductive member to a substantially uniform potential. This sensitizes the surface of the photoconductive member. The charged portion of the photoconductive surface is then exposed to a light image from either a modulated light source or from light reflected from an original document being reproduced. This creates an electrostatic latent image on the photoconductive surface. After the electrostatic latent image is created on the photoconductive surface, the latent image is developed. During development, toner particles are electrostatically attracted to the latent image recorded on the photoconductive surface. The toner particles form a developed image on the photoconductive surface. The developed image is then transferred to a copy sheet. Subsequently, the toner particles in the developed image are heated to permanently fuse the toner particles to the copy sheet.

SUMMARY OF THE INVENTION

Ambient room light is made of various wavelengths of light. Thus, when a photoconductive member is exposed to room light, for example, when the image forming system is serviced, random areas on the surface of the photoconductive member become light-shocked by the ambient room light. As a result, these light-shocked areas of the photoconductive member become more sensitive to the light used to form the latent image. Thus, the non-uniform room light causes non-uniform exposure voltages to accrue on imaging areas of the photoconductive member. Non-uniform exposure voltages across the imaging areas of the photoconductive member cause distortions in the electrostatic latent image developed on the imaging areas of the photoconductive member. Thus, the developed image on the photoconductive member includes image density variations, or distortions. As a result, when the developed image is subsequently transferred to a recording medium, the resulting image is distorted. These image distortions create images that would be objectionable to a customer.

Additionally, photoreceptors are relatively expensive. Unfortunately, during servicing, photoreceptors are often exposed to ambient room light. Thus, many photoreceptors are needlessly discarded by service personnel during servicing because of expected poor performance after these photoreceptors are exposed to ambient room light.

This invention provides apparatuses, systems and methods to maintain a photoreceptor in a uniformly light-shocked condition.

This invention separately provides apparatuses, systems and methods to supply a light source within a photocopy machine that will shine light on the photoreceptor.

This invention separately provides apparatuses, systems and methods to supply a light source within a photocopy machine that will shine high level, wide band fluorescent light on the photoreceptor.

This invention separately provides apparatuses, systems and methods that reduce the photoreceptor's sensitivity to ambient room light.

This invention separately provides apparatuses, systems and methods that limit a level of light shock to reduce the non-uniform voltages within the print area of the photoreceptor.

This invention separately provides apparatuses, systems and methods that limit a level of light shock to reduce defects in resulting images.

This invention separately provides apparatuses, systems and methods that limit a level of light shock to reduce adverse effects on the life of the photoreceptor.

This invention separately provides apparatuses, systems and methods that limit a level of light shock to reduce adverse effects on the performance of the photoreceptor This invention separately provides apparatuses, systems and methods for more effectively removing undeveloped toner particles from the surface of a photoreceptor.

In accordance with the apparatuses, systems and methods of this invention, various exemplary embodiments of the light exposure systems according to this invention use a light that constantly shines on the photoreceptor during normal printing. In various exemplary embodiments, the light includes a wide band fluorescent light.

Other exemplary embodiments of this invention include systems and methods that turn on a fluorescent light only during specific time periods. In various exemplary embodiments, the specific time periods include times during which special diagnostic routines are being performed. This allows a user or service personnel to operate the wide band fluorescent light if print quality appears to be poor, or after, or as part of, a servicing routine. In various exemplary embodiments, the specific time periods include time periods when the image forming system is not printing. The time periods when the image forming system is not printing could include, for example, time periods when the image forming system is in a warm-up or a shut-down cycle. In various exemplary embodiments, the specific time periods include time periods when a fault diagnostic system determines that the image forming system is in a condition requiring analysis or problem solving, such as, for example, any time that the doors of the image forming system are open.

Other exemplary embodiments of this invention include systems and methods that use a bank of lights that constantly shine light on the photoreceptor.

Other exemplary embodiments of this invention include systems and methods that use a bank of wide band fluorescent lights that constantly shine wide band fluorescent light on the photoreceptor.

These and other features and advantages of this invention are described in or are apparent from the following detailed description of various exemplary embodiments of the apparatuses, systems and methods of this invention.

BRIEF DESCRIPTION OF THE DRAWINGS

Various exemplary embodiments of this invention will be described in detail, with reference to the following figures, wherein.

DETAILED DESCRIPTION OF THE PREFERRED EMBODIMENTS

For simplicity and clarification, the operating principles, design factors, and layout of the light shock reduction systems and methods according to this invention are explained with reference to various exemplary embodiments of light shock reduction systems and methods according to this invention, as shown in FIGS. 1–4C. The basic explanation of the operation of the illustrated light shock reduction systems and methods is applicable for the understanding and design of the constituent components employed in the light shock reduction systems and methods of this invention.

Figure 1:
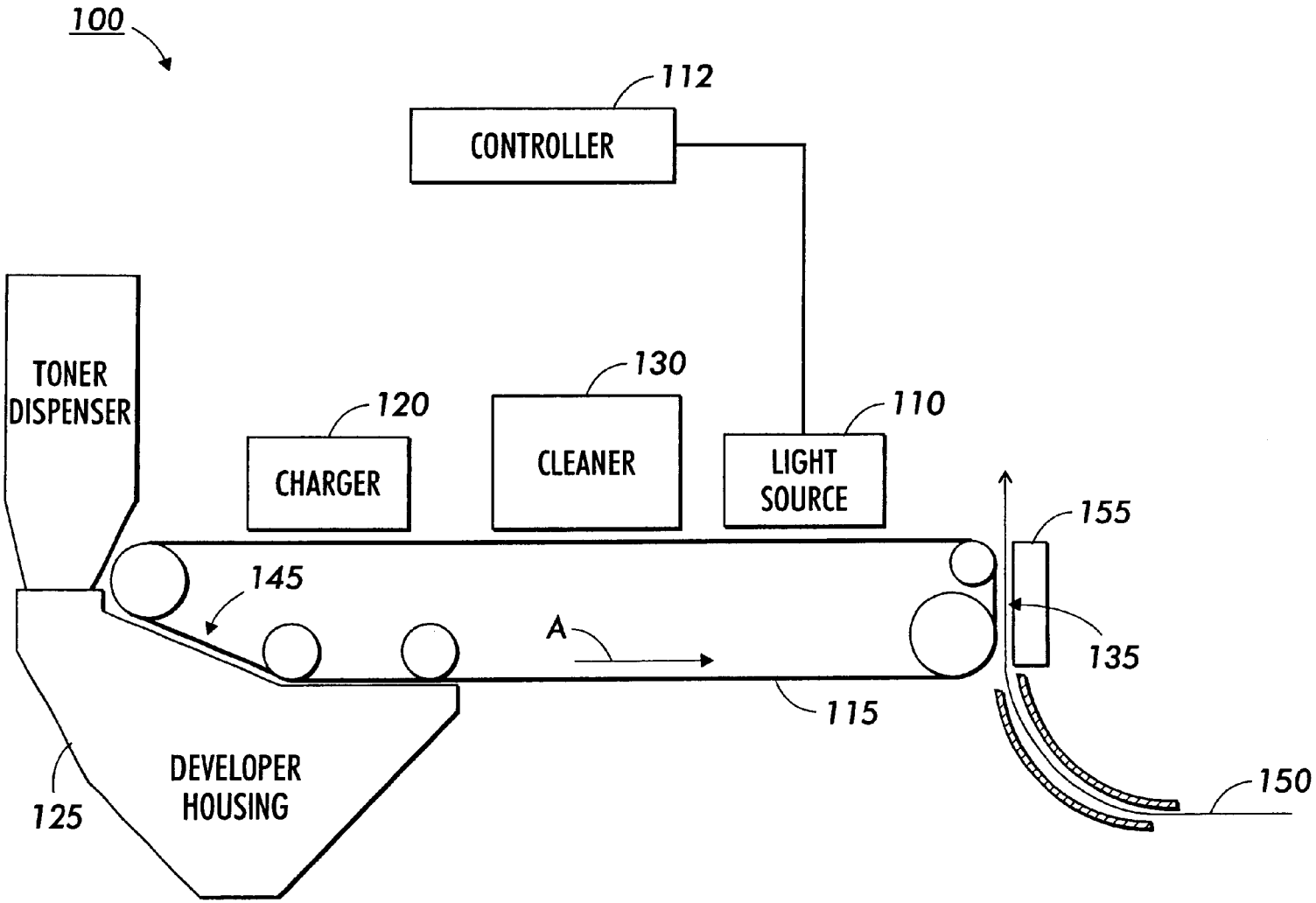
FIG. 1 is a side view showing the structure of an image forming system incorporating a first exemplary embodiment of a light shock reduction system according to this invention.

FIG. 1 shows an image forming system incorporating a first exemplary embodiment of a light shock reduction system 100 according to this invention. As shown in FIG. 1, the light shock reduction system 100 includes a light source 110 that is positioned adjacent to a photoreceptor 115 and a controller 112. In various exemplary embodiments, the light source 110 is one or more florescent lights. The photoreceptor 115 is a belt-type device that rotates in the direction A, and advances sequentially through various xerographic process steps.

A charger 120 is mounted adjacent to the photoreceptor 115. The charger 120 charges the photoreceptor to a predetermined potential and polarity. A toner dispenser/developer housing 125 is also mounted adjacent to the photoreceptor 115. The toner dispenser/developer housing 125 stores toner particles and dispenses the toner particles to the photoreceptor 115 to develop the latent image in an imaging/exposure/developing zone 145. A transfer dicorotron 155 is also mounted adjacent to the photoreceptor 115. The area between the transfer dicorotron 155 and the photoreceptor 115 form an image transfer zone 135. A cleaner 130 is also mounted adjacent to the photoreceptor 115. The cleaner 130 removes residual toner particles from the surface of the photoreceptor 115 after the developed image is transferred to an image recording medium from the photoreceptor 115.

In various exemplary embodiments, the light source 110 includes two or more lights. In various exemplary embodiments, the light source 110 includes a wide band florescent light. In various exemplary embodiments, the wide band florescent light has an output intensity of 25000 $\mu$W per centimeter of length. In various exemplary embodiments, the wide band florescent light has a wavelength that is tuned to optimize the performance of the particular photoreceptor 115 that the light source 110 is used with. In various exemplary embodiments, the light source 110 is a high intensity light source, such as, for example, an incandescent light.

If the light shock reduction system 100 includes multiple modes, the controller 112 is used to control which mode is active and to controllably turn on and off the light source 110. However, if the light reduction system 110 does not have either multiple modes or a mode that requires controllably turning on and off the light source 110, the controller 112 can be omitted. It should be appreciated that the controller 112 can be implemented as an independent control device or as a portion of the main controller of the image forming system in which the light shock reduction system 100 is implemented.

During operation of the light shock reduction system 100 according to this invention, as a portion of photoreceptor 115 passes by the charger 120, the charger 120 charges the photoconductive surface of photoreceptor 115 to a relatively high, substantially uniform potential $V_0$. Next, the charged portion of the photoconductive surface of photoreceptor 115 advances through an imaging/exposure/developing zone 145. In the imaging/exposure/developing zone 145, portions of the photoconductive surface of photoreceptor 115 are selectively discharged to form a latent electrostatic image. This latent image is developed on the photoconductive surface of the photoreceptor 115.

The photoreceptor 115, which is initially charged to a voltage $V_0$ by the charger 120, undergoes dark decay to a voltage level $V_{dd}$. In various exemplary embodiments, the dark decay voltage $V_{dd}$ is equal to about −500V. When developed at the imaging/exposure/developing zone 145, the exposed portions of the photoreceptor 115 are discharged to an exposure voltage $V_e$. In various exemplary embodiments, the exposure voltage $V_e$ is equal to about −50V. Thus, after exposure, the photoreceptor 115 has a bipolar voltage profile of high and low voltages. In various exemplary embodiments, the high voltages correspond to charged areas and the low voltages correspond to discharged or background areas. Thus, the photoreceptor 115 now has an electrostatic latent image formed on the surface of the photoreceptor 115.

As the photoreceptor 115 continues to move, the imaged portion of the photoreceptor 115 passes the toner dispenser/developer housing 125. The toner dispenser/developer housing 125 transfers charged toner particles to the imaged portions of the photoreceptor 115.

As the photoreceptor 115 continues to move, the developed image arrives at the image transfer zone 135. In the image transfer zone 135, a recording medium moves along a sheet path 150 in a timed sequence so that the developed image developed on the surface of the photoreceptor 115 contacts the advancing recording medium at image transfer zone 135.

In various exemplary embodiments of the image forming system, the image transfer zone 135 includes a transfer dicorotron 155, which applies a bias to the recording medium. In various exemplary embodiments, the dicorotron 155 sprays positive ions onto the backside of the recording medium. This attracts the charged toner particles of the developed image from the surface of the photoreceptor 115 to the recording medium.

After transfer, the recording medium continues to move along the sheet path 150. The recording medium is separated from the photoconductive surface of the photoreceptor 115. Then, the recording medium continues to move along the sheet path 150. A fusing station permanently affixes the toner particles of the transferred image to the recording medium.

As the photoreceptor 115 continues to move, the photoreceptor 115 passes the light source 110. The light source 110 shines high level, wide band light onto the photoreceptor 115. This wide band light uniformly light shocks the photoreceptor 115. This light shock reduces the photoreceptor's sensitivity to ambient room light and other stray light that may enter the image forming system or otherwise impinge on the photoreceptor 115.

In various exemplary embodiments, the high level, wide band light from the light source 110 also aids in neutralizing any remaining voltages remaining from the electrostatic latent image formed on the surface of the photoreceptor 115. Thus, any remaining charged toner particles carried on the photoconductive surface of the photoreceptor 115 will no longer be as strongly attracted to the surface of the photoreceptor 115. As the photoreceptor 115 continues to move, the photoreceptor 115 passes the cleaner 130. The cleaner 130 removes any remaining toner particles from the surface of the photoreceptor 115.

In other exemplary embodiments, the light source 110 may be two or more light sources. One or more of the light sources may be oriented to expose a portion of photoreceptor 115 to the high-level wide band light before that portion of the photoreceptor 115 reaches the cleaner 130. The other one or more light sources may be oriented to expose the portion of the photoreceptor 115 to the high-level wide band light after that portion of the photoreceptor 115 travels past the cleaner 130. Using two sets of one or more light sources each in this manner tends to make the cleaner 130 more effective and reduce the chance that remaining toner particles will shadow the photoreceptor 115.

In yet other exemplary embodiments, the light source 110 may be located in another portion of the photocopy machine. In such exemplary embodiments, the high-level wide band light from the light source 110 could shine on the photoreceptor 115 through the use of, for example, a light pipe.

Figure 2:
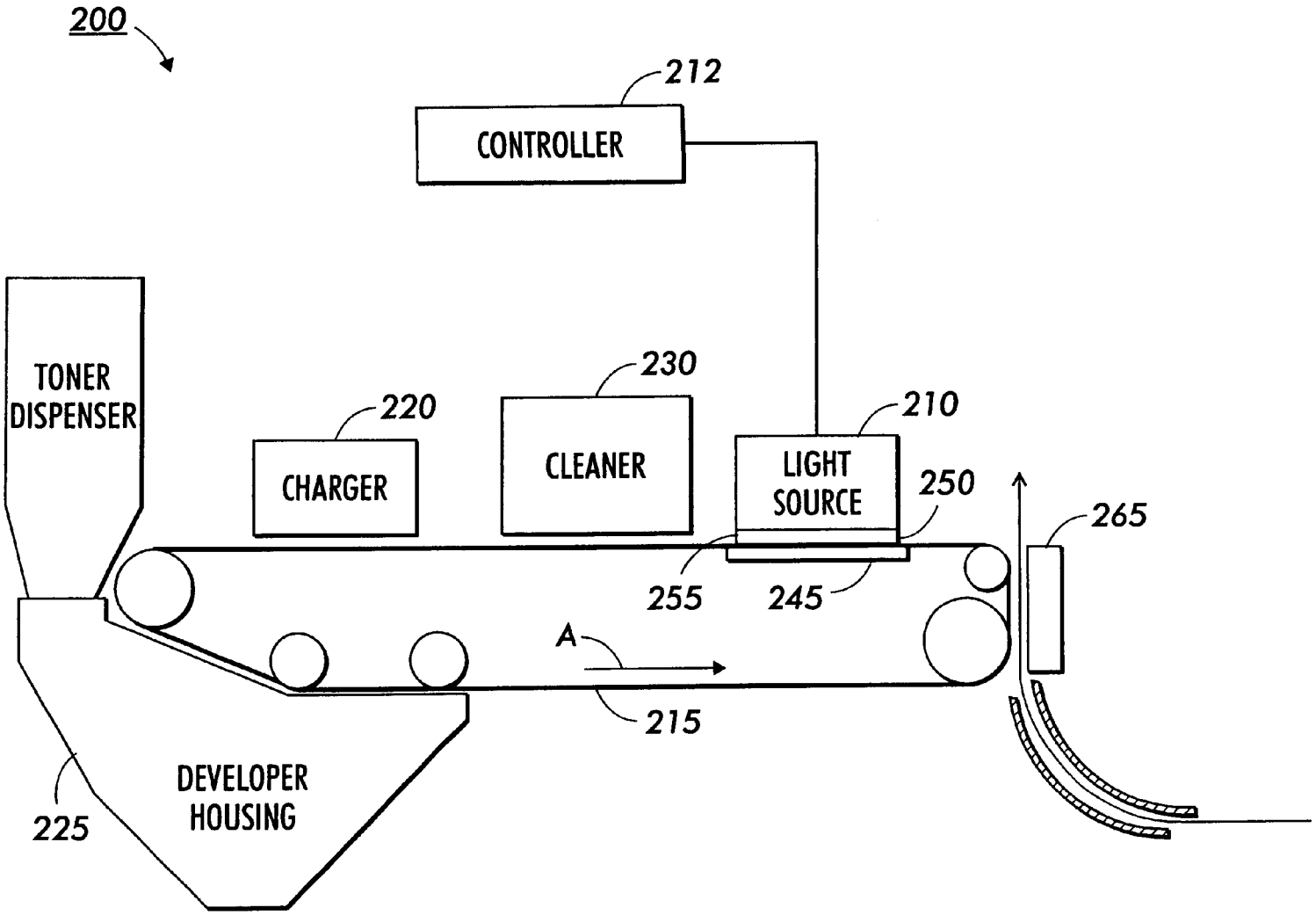
FIG. 2 is a side view showing the structure of an image forming system incorporating a second exemplary embodiment of a light shock reduction system according to this invention.

FIG. 2 shows an image forming system incorporating a second exemplary embodiment of a light shock reduction system 200. As illustrated in FIG. 2, light shock reduction system 200 includes a controller 212 and a light source 210, which is positioned relative to a photoreceptor 215, a charger 220, a toner dispenser/developer housing 225, a cleaner 230, and a transfer dicorotron 255. Each of these elements corresponds to one of the elements discussed above with respect to FIG. 1.

However, light shock reduction system 200 further includes a number of light sealing elements 245, 250 and 255. The light sealing elements 250 and 255 are attached to a housing of the light source 210. The light sealing element 245 is positioned on the side of the photoreceptor 215 opposite the light source 210. The light sealing elements 245, 250 and 255 are positioned to reduce, if not prevent, any stray light from the light source 210 from entering other areas of the imaging forming device that incorporates the light shock reduction system 200 according to this invention. In various exemplary embodiments, at least one of the light sealing elements 245, 250 and 255 has a reflective surface where the reflective surface faces the photoreceptor 215. In various exemplary embodiments, the reflective surface of at least one of the light sealing elements 245, 250 and 255 reflects light from the light source 210 toward the photoreceptor 215.

If the light shock reduction system 200 includes multiple modes, the controller 212 is used to control which mode is active and to controllably turn on and off the light source 210. However, if the light reduction system 210 does not have either multiple modes or a mode that requires controllably turning on and off the light source 210, the controller 212 can be omitted. It should be appreciated that the controller 212 can be implemented as an independent control device or as a portion of the main controller of the image forming system in which the light shock reduction system 200 is implemented.

In other exemplary embodiments, the light sources 110 and/or 210 may be located inside the circumference of the photoreceptor 115.

Figure 3:
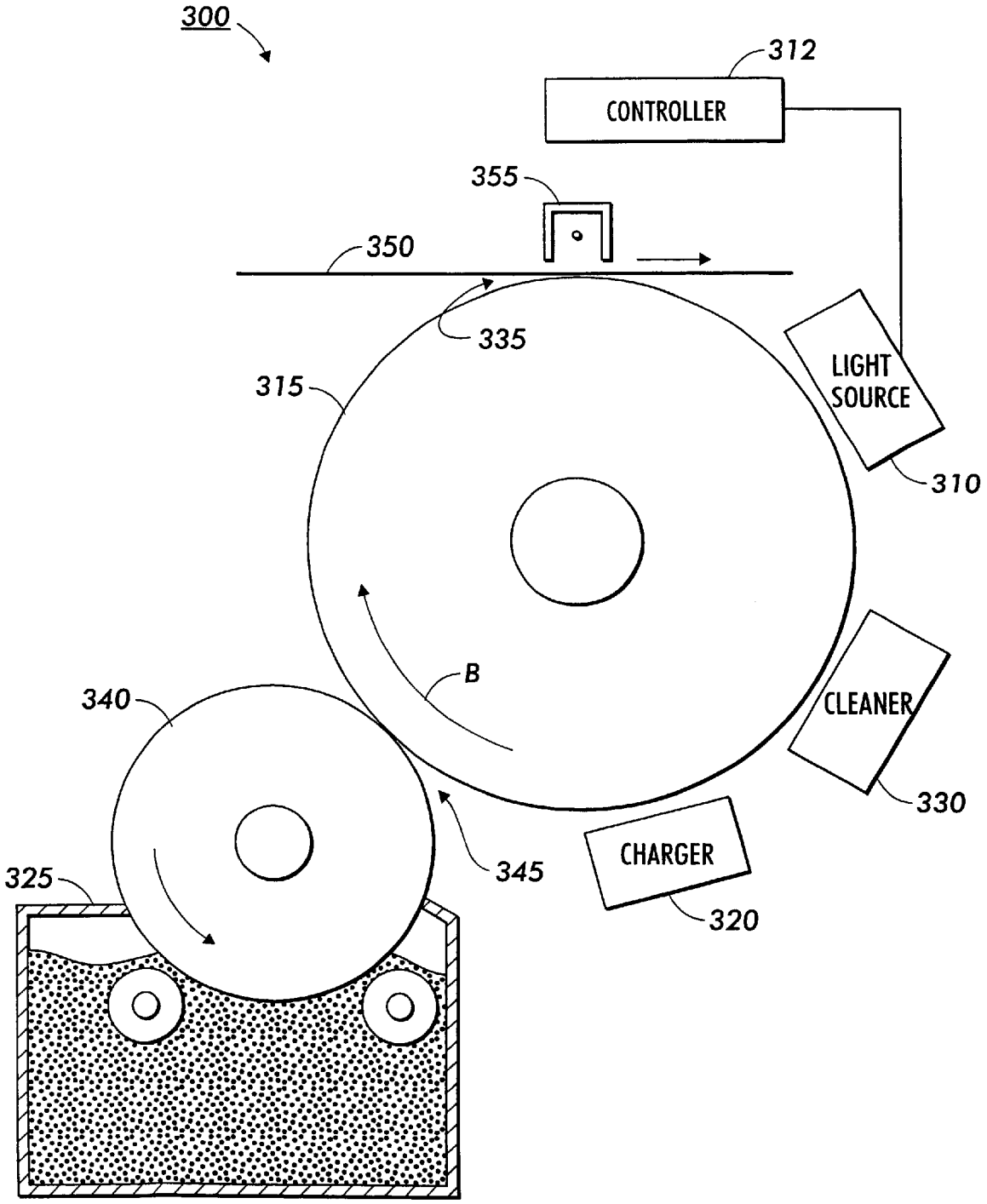
FIG. 3 is a side view showing the structure of an image forming system incorporating a third exemplary embodiment of a light shock reduction system according to this invention.

FIG. 3 shows an image forming system incorporating a third exemplary embodiment of a light shock reduction system 300 according to this invention. As illustrated in FIG. 3, the light shock reduction system 300 includes a light source 310 that is positioned adjacent to a drum-type photoreceptor 315 and a controller 312. In various exemplary embodiments, the light source 310 is one or more florescent lights. The photoreceptor 315 is a drum-type device that rotates in the direction B and advances sequentially through various xerographic process steps.

A charger 320 is mounted adjacent to the photoreceptor 315. The charger 320 charges the photoreceptor to a predetermined potential and polarity. A toner dispenser/developer housing 325 is also mounted adjacent to the photoreceptor 315. The toner dispenser/developer housing 325 stores toner particles and dispenses the toner particles to the photoreceptor 315 to develop the latent image. A transfer dicorotron 355 is also mounted adjacent to the photoreceptor 315. The area between the transfer dicorotron 355 and the photoreceptor 315 forms an image transfer zone 335. A cleaner 330 is also mounted adjacent to the photoreceptor 315. The cleaner 330 removes residual toner particles from the surface of the photoreceptor 315 after the developed image is transferred to an image recording medium from the photoreceptor 315.

The light source 310, the photoreceptor 315, the charger 320, the toner dispenser/developer housing 325, the cleaner 330, and the transfer dicorotron 355 correspond to and operate similarly to the same elements discussed above with respect to FIGS. 1 and/or 2.

If the light shock reduction system 300 includes multiple modes, the controller 312 is used to control which mode is active and to controllably turn on and off the light source 310. However, if the light reduction system 310 does not have either multiple modes or a mode that requires controllably turning on and off the light source 310, the controller 312 can be omitted. It should be appreciated that the controller 312 can be implemented as an independent control device or as a portion of the main controller of the image forming system in which the light shock reduction system 300 is implemented.

During operation of the light shock reduction system 300 according to this invention, as a portion of the photoreceptor 315 rotates by the charger 320, the charger 320 charges the photoconductive surface of photoreceptor 315 to a relatively high, substantially uniform potential $V_0$. Next, the charged portion of the photoconductive surface of photoreceptor 315 rotates through an imaging/exposure/developing zone 345. In imaging/exposure/developing zone 345, portions of the photoconductive surface of the photoreceptor 315 are selectively discharged to form a latent electrostatic image. This latent image is then developed on the photoconductive surface of photoreceptor 315.

The photoreceptor 315, which is initially charged to a voltage $V_0$ by charger 320, undergoes dark decay to a voltage level $V_{dd}$. In various exemplary embodiments, the dark decay voltage $V_{dd}$ is equal to about −500V. When exposed at the imaging/exposure/developing zone 345, the exposed portions of the photoreceptor 315 are discharged to an exposure voltage Ve. In various exemplary embodiments, the exposure voltage $V_e$. is equal to about −50V. Thus, after exposure, the photoreceptor 315 has a bipolar voltage profile of high and low voltages. In various exemplary embodiments, the high voltages correspond to charged areas and the low voltages correspond to discharged or background areas. Thus, the photoreceptor 315 now has an electrostatic latent image formed on the surface of the photoreceptor 315.

As the photoreceptor 315 continues to rotate, the imaged portion of the photoreceptor 315 passes the toner dispenser/developer housing 325. The toner dispenser/developer housing 325 transfers charged toner particles to the imaged portions of the photoreceptor 315.

As the photoreceptor 315 continues to rotate, the developed image arrives at the image transfer zone 335. In the image transfer zone 335, a recording medium moves along a sheet path 350 in a timed sequence so that the developed image developed on the surface of the photoreceptor 315 contacts the advancing recording medium at image transfer zone 335.

In various exemplary embodiments of the image forming system, the image transfer zone 335 includes a transfer dicorotron 355, which applies a bias to the recording medium. In various exemplary embodiments, the dicorotron 355 sprays positive ions onto the backside of the recording medium. This attracts the charged toner particles of the developed image from the surface of the photoreceptor 315 to the recording medium.

After transfer, the recording medium continues to move along the sheet path 350. The recording medium is separated from the photoconductive surface of the photoreceptor 315. Then, the recording medium continues to move along the sheet path 350. A fusing station permanently affixes the toner particles of the transferred image to the recording medium.

As the photoreceptor 315 continues to rotate, the photoreceptor 315 passes the light source 310. The light source 310 shines high level, wide band light onto the photoreceptor 315. This wide band light uniformly light shocks the photoreceptor 315. This light shock reduces the photoreceptor's sensitivity to ambient room light.

In various exemplary embodiments, the high level, wide band light from the light source 310 also aids in neutralizing any remaining voltages remaining from the electrostatic latent image formed on the surface of the photoreceptor 315. Thus, any remaining charged toner particles carried on the photoconductive surface of the photoreceptor 315 will no longer be as strongly attracted to the surface of the photoreceptor 315. As the photoreceptor 315 continues to rotate, the photoreceptor 315 passes the cleaner 330. The cleaner 330 removes any remaining toner particles from the surface of the photoreceptor 315.

In other exemplary embodiments, the housing of light source 310 may include the light sealing elements discussed above with respect to FIG. 2.

In other exemplary embodiments, the light source 310 may include two or more light sources. One or more of the light sources may be oriented to expose a portion of photoreceptor 315 to the high-level wide band light before that portion of the photoreceptor 315 reaches the cleaner 330. The other one or more light sources may be oriented to expose the portion of the photoreceptor 315 to the high-level wide band light after that portion of the photoreceptor 315 travels past the cleaner 330. Using two sets of one or more light sources each in this manner tends to make the cleaner 330 more effective and reduce the chance that remaining toner particles will shadow the photoreceptor 315.

In yet other exemplary embodiments, the light source 310 may be located in another portion of the photocopy machine. In such exemplary embodiments, the high-level wide band light from the light source 310 could shine on the photoreceptor 315 through the use of, for example, a light pipe.

Figure 4A:
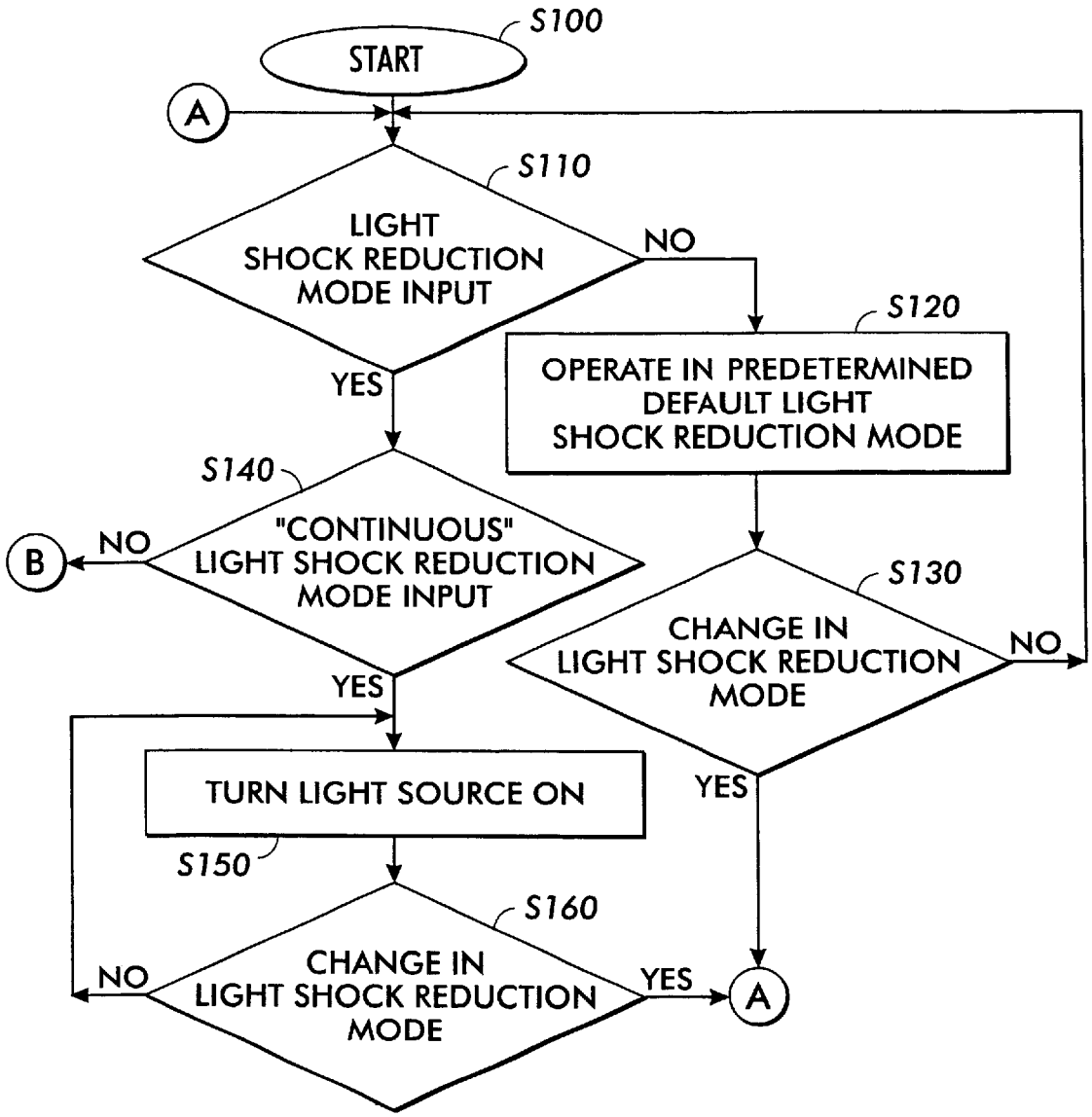
FIGS. 4A–4C show a flowchart outlining one embodiment of a control routine using the light shock reduction system of this invention.
Figure 4B:
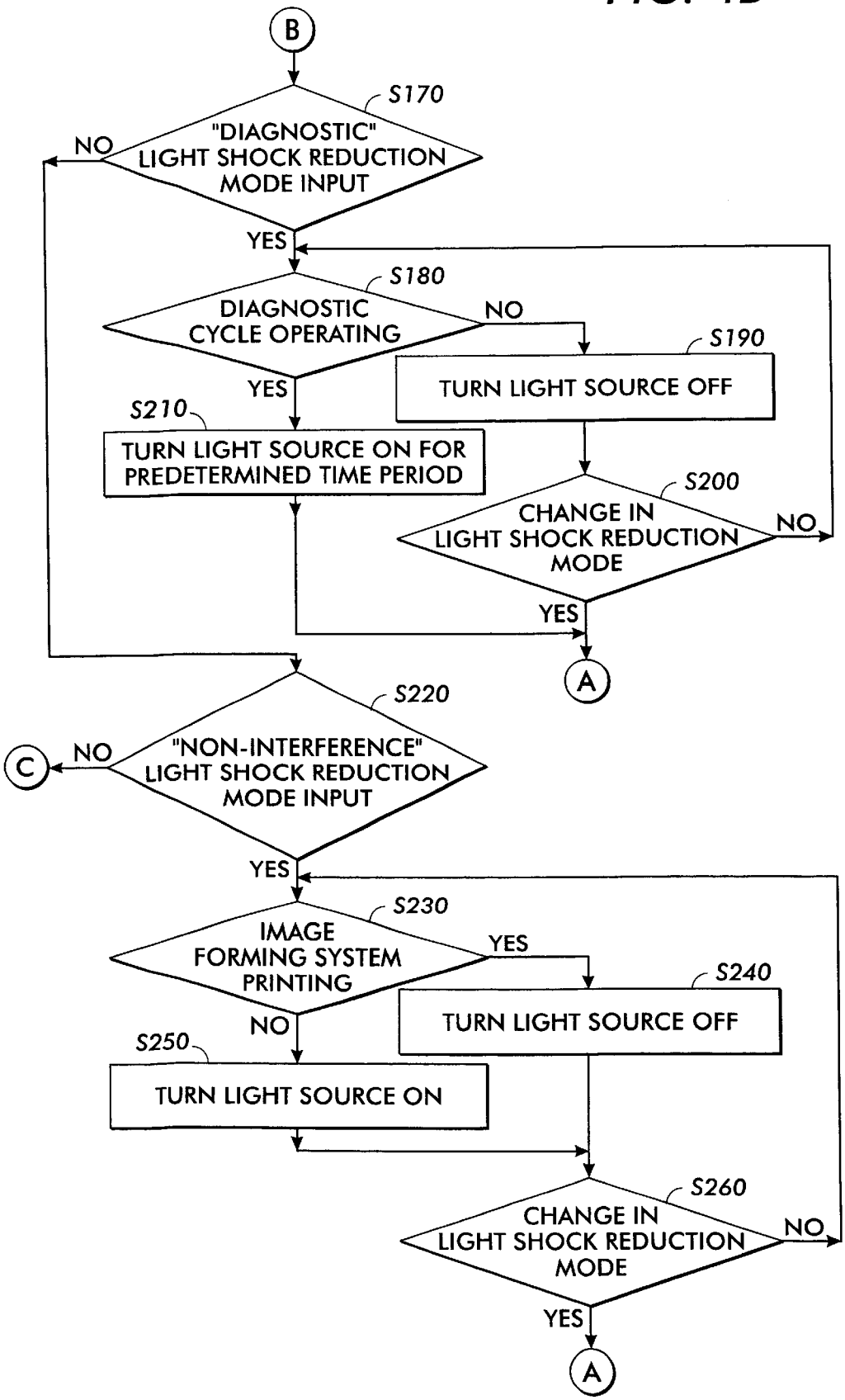
Figure 4C:
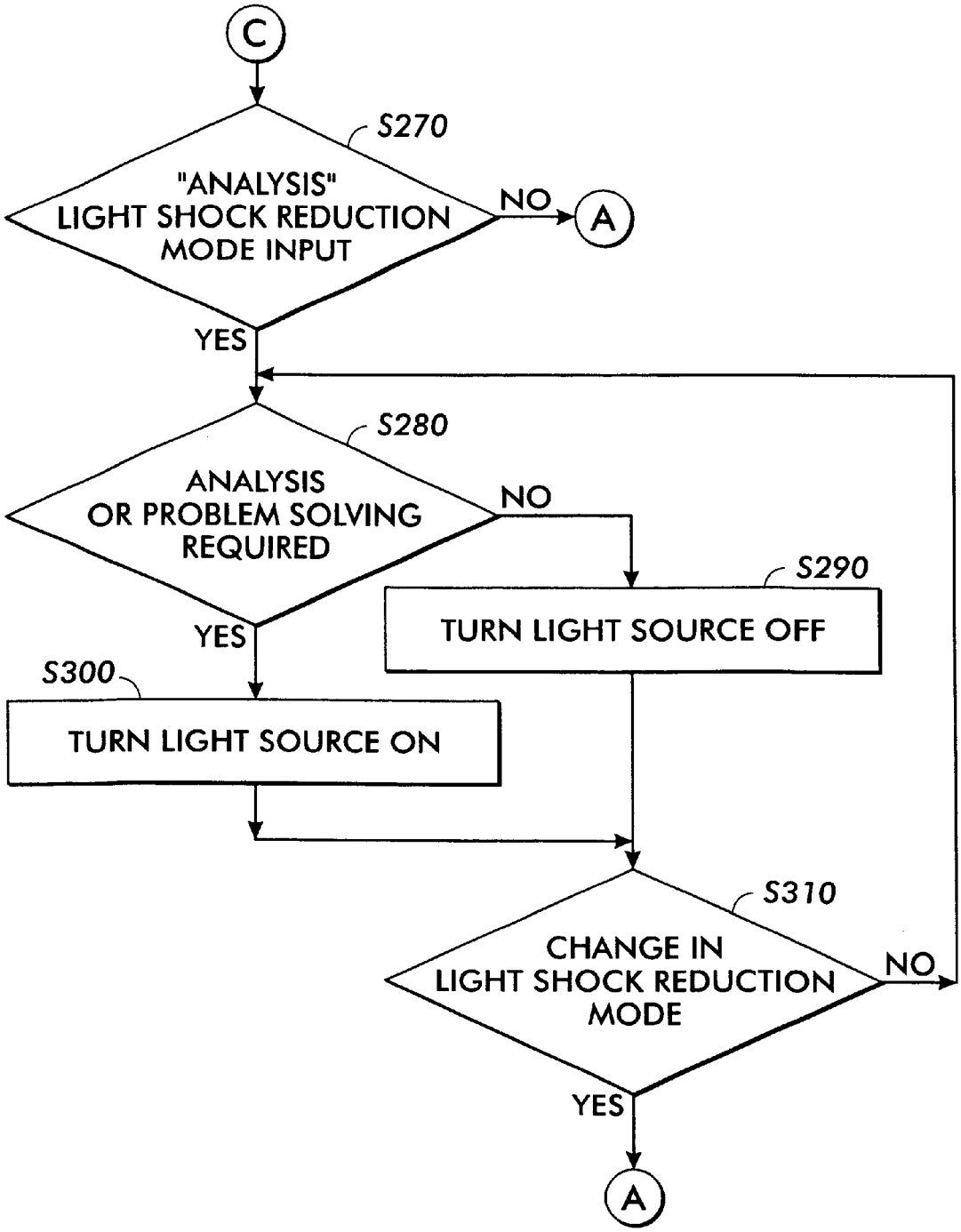

FIGS. 4A–4C are a flowchart outlining one exemplary embodiment of a method for controllably light shocking a photoreceptor according to this invention. A user can toggle between various light shock reduction modes, such as, for example, a "continuous" mode, a "diagnostic" mode, a "non-interference" mode, or an "analysis" mode. In the "continuous" mode, the light source constantly shines on an adjacent photoreceptor. In the "diagnostic" mode, the light source only shines on the adjacent photoreceptor when special diagnostic routines are being performed. This allows a user or service personnel to operate the wide band fluorescent light if print quality appears to be poor, or after, or as part of, a servicing routine. In the "non-interference" mode, the light source only shines on the adjacent photoreceptor during a time period when the image forming system is not printing. The time periods when the image forming system is not printing could include, for example, time periods when the image forming system is in a warm-up or a shut-down cycle. Finally, in the "analysis" mode, the light source shines on the adjacent photoreceptor if a fault diagnostic system determines that the image forming system is in a condition requiring analysis or problem solving, such as, for example, any time that the doors of the image forming system are open.

As shown in FIGS. 4A—4C, beginning in step S100, control continues to step S110, where a determination is made whether a light shock reduction mode has been selected. If, in step S110, a light shock reduction mode has not been selected, control advances to step S120. Otherwise control jumps to step S140.

In step S120, the light source is operated in a default light shock reduction mode. In the default light shock reduction mode, the light source is turned on. Then, in step S130, a determination is made whether there has been a change to the selected light shock reduction mode. If there is a change in the selected light shock reduction mode control routine returns to step S110. Otherwise, if there is no change to the selected light shock reduction mode, control returns to step S120, and the light source continues to be operated in the predetermined default light shock reduction mode.

In step S140, a determination is made whether a "continuous" light shock reduction mode has been selected in step S110. If the "continuous" light shock reduction mode was selected in step S110, control advances to step S150. Otherwise, control jumps to step S170.

In step S150, the light source is turned on. Next, in step S160, a determination is made whether there has been a change to the selected light shock reduction mode. If there is a change to the selected light shock reduction mode, control returns to step S110. Otherwise, if there is no change to the light shock reduction mode input, control returns to step S150, and the light source continues to be operated on the continuous light shock reduction mode.

In step S170, a determination is made whether a "diagnostic" light shock reduction mode was selected in step S110. If the "diagnostic " light shock reduction mode was selected in step S110, control advances to step S180. Otherwise, control jumps to step S220.

In step S180, a determination is made whether a diagnostic cycle is operating in the image forming system. If so, control jumps to step S210. Otherwise, control advances to step S190.

In step S190, the light source is turned off. Then, in step S200, a determination is made whether there has been a change to the selected light shock reduction mode. If there is a change to the selected light shock reduction mode input, control returns to step S110. Otherwise, if there is no change to the selected light shock reduction mode, control returns to step S180.

In step S210, the light source is turned on for a limited period of time. Once the light source has been on for the limited period of time, control returns to step S110.

In step S220, a determination is made whether a "non-interference" light shock reduction mode was selected in step S110. If the "non-interference " light shock reduction mode was selected in step S110, control advances to step S230. Otherwise, control jumps to step S270.

In step S230, a determination is made whether the image forming system is printing. If the image forming system is printing, the control advances to step S240. Otherwise, control jumps to step S250.

In step S240, the control routine turns the light source off control directly then jumps to step S260. In contrast, in step S260, the control routine turns the light source on. Then, in step S260, a determination is made whether there has been a change to the selected light shock reduction mode. If there is a change in the light shock reduction mode input, control returns to step S110. If there is no change to the selected light shock reduction mode input, control returns to step S230.

Once the light source is turned on, the control system returns to step S110.

In step S270, a determination is made whether an "analysis" light shock reduction mode was selected in step S110. If the "analysis" light shock reduction mode was selected in step S110, control advances to step S280. Otherwise, control returns to step S110.

In step S280, a determination is made whether a fault diagnostic system has determined that the image forming system is in an analysis or problem solving condition requiring actions, such as, for example, a door to be opened, that will permit ambient light to illuminate the photoreceptor member. If in step S280, the image forming device is not in an analysis or problem solving condition, control advances to step S290. Otherwise, control jumps to step S300.

In step S290, the light source is turned off. Control then jumps to step S310. In contrast, step S300, the light source is turned on. Then, in step S300, a determination is made whether there has been a change to the selected input light shock reduction mode. If there is a change to the selected light shock reduction mode, control returns to step S110. Otherwise, if there is no change to the selected light shock reduction mode, control returns to step S280.

It should be appreciated that, if any one of the above described light shock reduction modes is omitted from any particular embodiment, the flowchart outlined in FIGS. 4A–4C will be modified accordingly. Similarly, should the implemented light shock reduction system include additional light shock reduction modes, the flowchart outlined in FIGS. 4A–4C will be adjusted accordingly to incorporate steps similar to those described above for these additional light shock reduction modes. Similarly, the default light shock reduction mode could in fact be any one of the implemented light shock reduction modes.

Furthermore, it should be appreciated that, rather than the user selecting the light shock reduction mode, the light shock reduction mode could be determined automatically by the image forming system based on various control parameters, such as, for example, the light shock reduction mode could be automatically selected based on any number of control criteria. Such control criteria could include, for example, the age of the photoreceptor, the length of time since the image forming system was last serviced, the diagnostic history of the image forming apparatus and/or any other desired control criteria.

In various exemplary embodiments described above, the light exposure systems have been described with reference to a florescent light source. However, it should be appreciated that any known or later developed high intensity light source can be used in conjunction with, or in place of, the light source described above. Furthermore, the light exposure systems described above have been described within a single color electrophotographic marking process. However, it should be appreciated that any known or later developed image forming system that uses a photoconductive member could be modified to incorporate the light exposure systems and methods according to this invention.

The controllers 112, 212, and 312 shown in FIGS. 1–3, if implemented as independent control devices, can be implemented using a programmed microprocessor or microcontroller and peripheral integrated circuit elements, and ASIC or other integrated circuit, a digital signal processor, a hardwired electronic or a logic circuit such as a discrete element circuit, a programmable logic device such as a PLV, PLA, FPGA or PAL or the like. In other exemplary embodiments, where the controllers 112, 212 and/or 312 are implemented as part of the control system of the image forming apparatus in which the light shock reduction system 100, 200 or 300, respectively is implemented, the controllers 112, 212 and/or 312 can be implemented using a programmed general purpose computer or any other device capable of implementing the general control system for the image forming system. Such other devices include a special purpose computer, a programmed microprocessor or microcontroller and a peripheral integrated circuit elements, and ASIC or other integrated circuit, a digital signal processor, a hardwired electronic or logic circuit such as discrete element circuit, a programmable logic device such as a PLV, PLA, FPGA or PAL or the like. In general, any device, capable of implementing a finite state machine that is in turn capable of implementing the flowchart shown in FIGS. 4A–4C, can be used to implement the controllers 112, 212 and/or 312.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An image forming apparatus, comprising:

a light-sensitive photoconductive member; and a light source positioned adjacent to the photoconductive member without obstruction that supplies high-intensity light to the photoconductive member, the high-intensity light emitted by the light source placing the photoconductive member in a controlled, light-shocked state.

2. The image forming apparatus of claim 1, wherein the light source is a wide band fluorescent light.

3. The image forming apparatus of claim 2, wherein the wide band fluorescent light is tuned to maximize the performance of the photoconductive member.

4. The image forming apparatus of claim 1, wherein the high intensity light is tuned to maximize the performance of the photoconductive member.

5. The image forming apparatus of claim 1, wherein the light constantly shines on the photoconductive member during printing.

6. The imaging forming apparatus of claim 1, wherein the image forming apparatus is one of a laser printer, a xerographic copier, an analog copier, a digital copier, a color copier, a color printer, and a facsimile machine.

7. The imaging forming apparatus of claim 1, wherein the light-sensitive photoconductive member comprises at least one of at least one photoconductive drum and at least one photoconductive belt member.

8. A method for improving print quality of an image forming device, comprising:

positioning a light source adjacent to a light-sensitive photoconductive member without obstruction;

shining high-intensity light from the light source on the light-sensitive photoconductive member; and maintaining the light-sensitive photoconductive member in a controlled, light-shocked state by shining the high-intensity light on the light-sensitive photoconductive member.

9. The method of claim 8, wherein shining the light includes shining a wide band fluorescent light.

10. The method of claim 8, wherein shining the light includes shining wide band fluorescent light that is tuned to maximize a performance of the photoconductive member.

11. The method of claim 8, wherein shining the light includes continuously shining a light on the photoconductive member during printing.

* * * * *